US007536896B1

(12) United States Patent
Hung

(10) Patent No.: US 7,536,896 B1
(45) Date of Patent: May 26, 2009

(54) PLIERS

(76) Inventor: Cheng-Hao Hung, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 12/034,663

(22) Filed: Feb. 21, 2008

(51) Int. Cl.
*H01R 43/042* (2006.01)
*B21D 7/06* (2006.01)

(52) U.S. Cl. ..... 72/409.16; 72/409.11; 72/413; 72/416; 72/477; 81/422; 81/424; 29/751

(58) Field of Classification Search ..... 72/409.1, 72/409.11, 409.16, 413, 416, 477; 81/422, 81/424; 29/751, 753
See application file for complete search history.

(56) References Cited

U.S. PATENT DOCUMENTS 1,110,528 A * 9/1914 Borresen ..... 81/424
1,321,208 A * 11/1919 Hinnershitz ..... 81/424
2,900,854 A * 8/1959 Werner ..... 81/422
3,103,245 A * 9/1963 Iskyan ..... 72/318
4,926,685 A * 5/1990 Shannon, Sr. ..... 72/409.11
5,802,908 A * 9/1998 Frenken ..... 72/409.16
6,109,088 A * 8/2000 Schrader et al. ..... 72/409.16
7,024,911 B2 * 4/2006 Delhumeau et al. ..... 72/409.16
7,237,426 B2 * 7/2007 Baker et al. ..... 72/409.16

* cited by examiner

*Primary Examiner*—David B Jones

(57) ABSTRACT

Pliers include a left grip, a right grip, a positioned clamping base, a movable clamping base, two clamping members and two gears. Each of the positioned clamping base and the movable clamping base has a notch, a recess, a hole cut on the top of the notch and the bottom of the recess respectively, a through hole bored in the bottom of the notch to communicate with the recess. Two clamping members are respectively fitted in each notch, provided with plural plates, plural curved grooves formed in one of them and plural curved projections formed in the other, a bar and a shaft formed on their tops and their bottoms respectively. Each of the recesses is fitted with a gear provided with a through hole. Thus, the invention can be used to press diverse specifications of conducting line.

2 Claims, 7 Drawing Sheets

PLIERS

BACKGROUND OF THE INVENTION

1. Field of the Invention

This invention relates to pliers, particularly to one able to press conducting lines with diverse specifications.

2. Description of the Prior Art

Commonly, a terminal is fixed at one end of diverse conducting lines, such as signal lines, power lines and control lines, so as to be conveniently jointed with other means. And, it always requires terminal pliers to press the terminal together with the end of a conducting line. As shown in FIG. 1, conventional terminal pliers 1 mainly includes a left grip 10 and a right grip 11, which are respectively provided with a right jaw 12 and a left jaw 13 formed at their upper portions to intersect with each other. A pressing block 14 is located on the right jaw 12 and a recessed base 15 is positioned on the left jaw 13. In using, firstly, a terminal and the fixing end of the conducting line wrapped with insulating plastics are simultaneously positioned in the recess base 15; then, the user holes and applies a force to the left grip 10 and the right grip 11 to move toward each other, so as to enable the pressing block 14 to force the fixing end of the conducting line fixed together with the terminal in the recessed base 15. However, the conventional pliers are provided with only a pressing block 14 and a recessed base 15, available for merely a specification of connection. If various specifications are required, a user has to prepare different pliers to meet the need, not only having a high cost of tools but also inconvenient for using and carrying around.

SUMMARY OF THE INVENTION

The objective of this invention is to offer pliers able to press conducting lines with various specifications.

The main characteristics of the invention are a left grip, a right grip, a positioned clamping base, a movable clamping base, two clamping members, and two gears. The positioned clamping base and the movable clamping base are respectively fixed on the left grip and the right grip, and pivotally jointed together by a pivot. Each of the positioned clamping base and the movable clamping base is provided with a notch, a recess, a hole cut on the top of the notch and the bottom of the recess respectively, a through hole bored in the bottom of the notch to communicate with the recess. The clamping members are respectively fitted in each notch of the positioned clamping base and the movable clamping base, provided with plural plates, plural curved grooves formed in the plates of one of them, plural curved projections formed in the plates of the other to correspond to the curved grooves, a bar and a shaft respectively formed on their tops and their bottoms. Each of the recesses of the positioned clamping base and the movable clamping base is fitted with a gear provided with a through hole.

BRIEF DESCRIPTION OF DRAWINGS

This invention is better understood by referring to the accompanying drawings, wherein.

DETAILED DESCRIPTION OF THE PREFERRED EMBODIMENT

Figure 1:
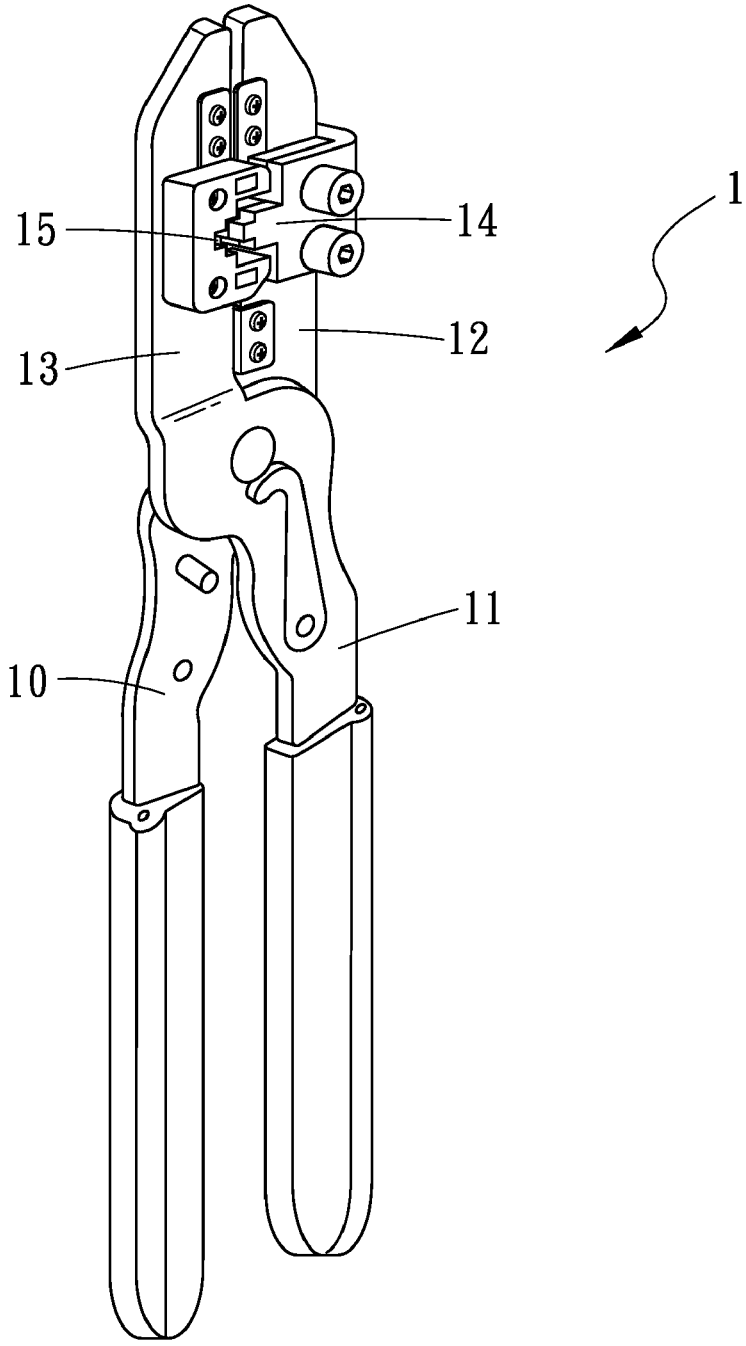
FIG.1 (PRIOR ART)
FIG. 1 is a perspective view of conventional pliers.
Figure 2:
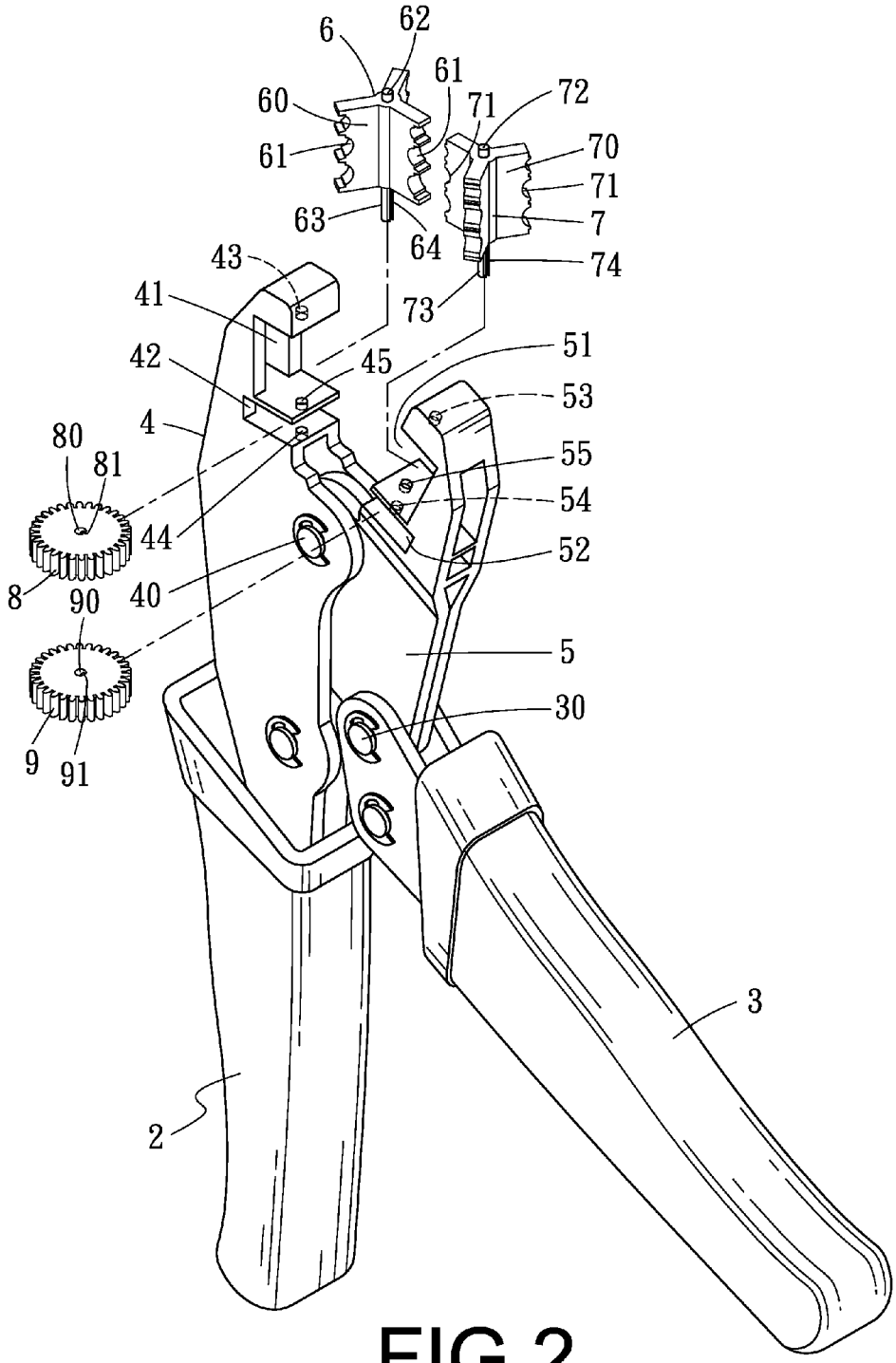
FIG. 2 is an exploded perspective view of a preferred embodiment of pliers in the present invention.
Figure 3:
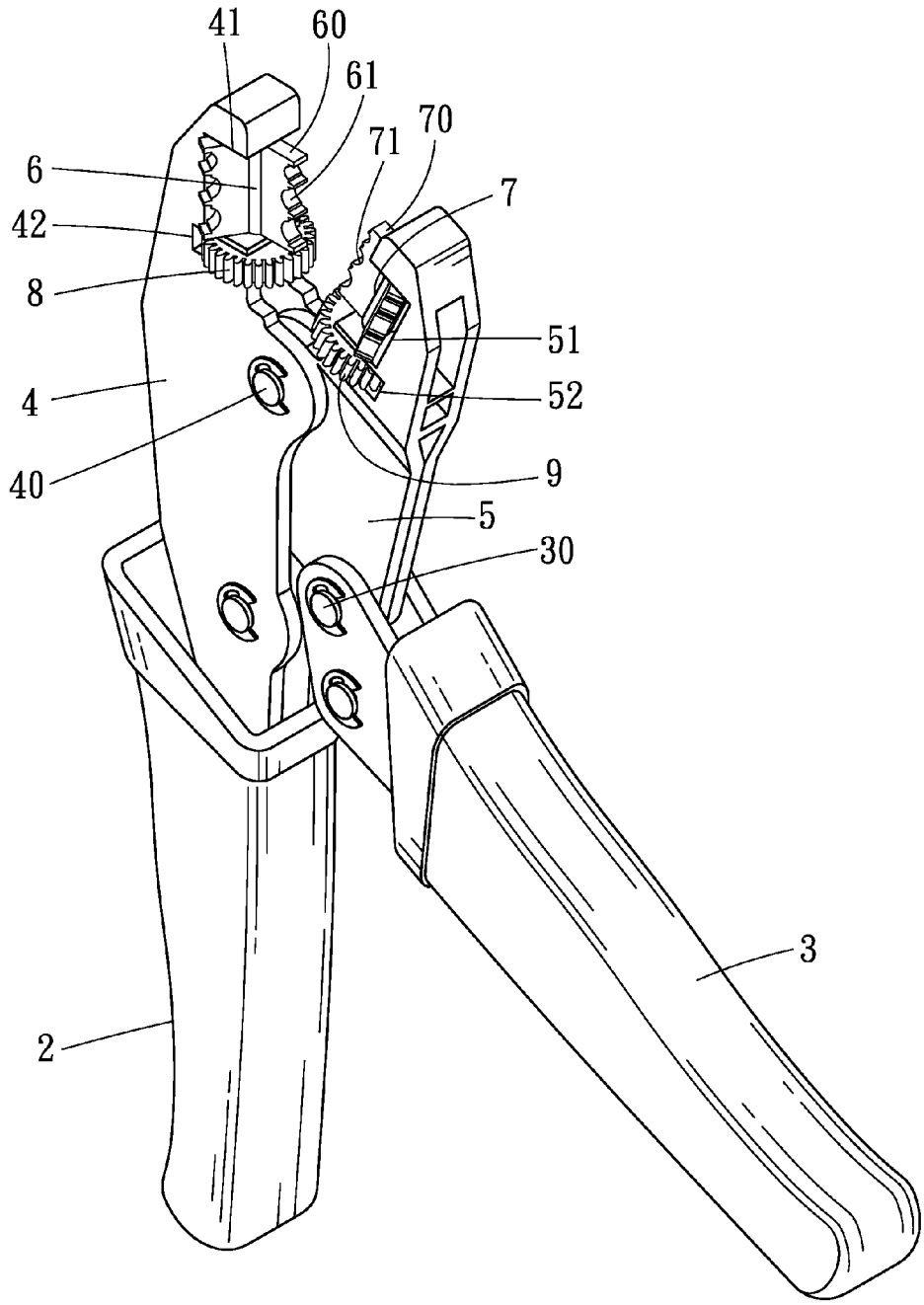
FIG. 3 is a perspective view of the preferred embodiment of pliers in the present invention.
Figure 4:
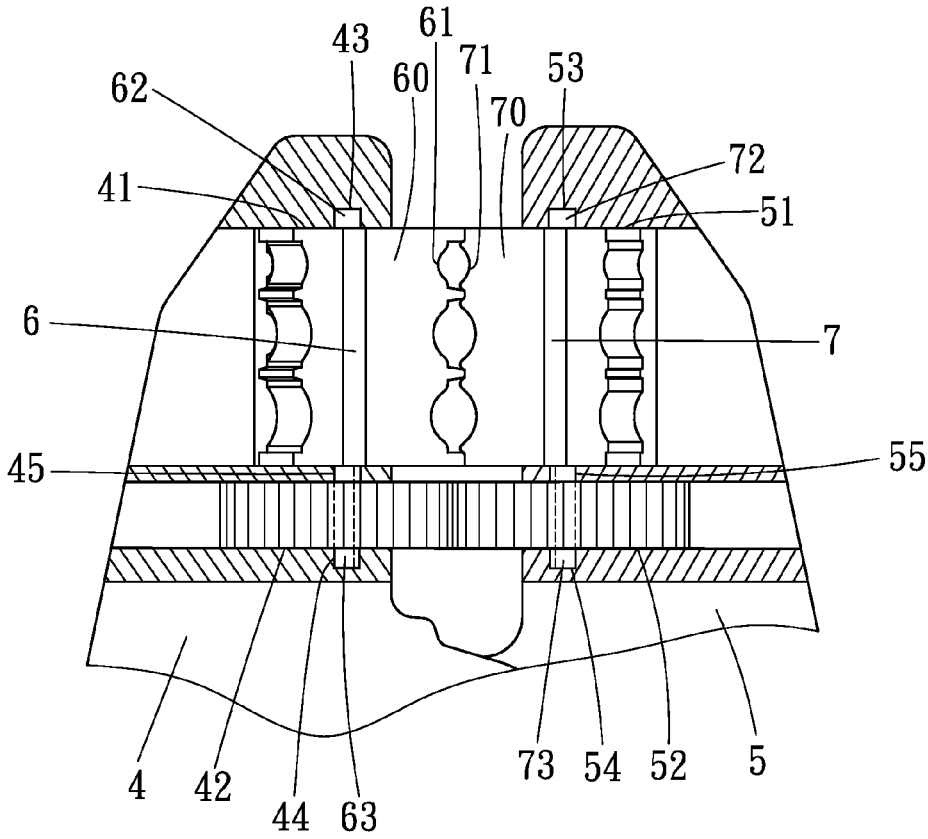
FIG. 4 is an enlarged side view of the preferred embodiment of pliers in the present invention.
Figure 5:
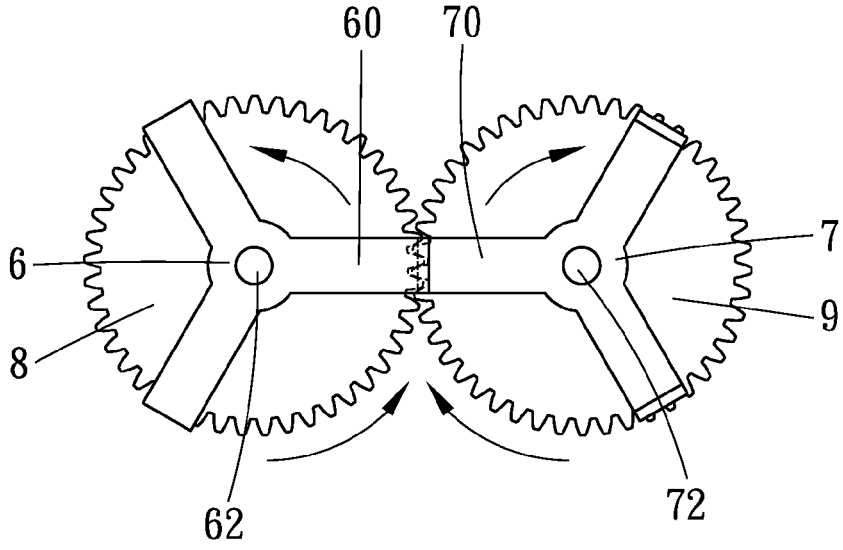
FIG. 5 is a top view of the preferred embodiment of pliers in the present invention, showing clamping members being driven by rotation of gears.
Figure 6:
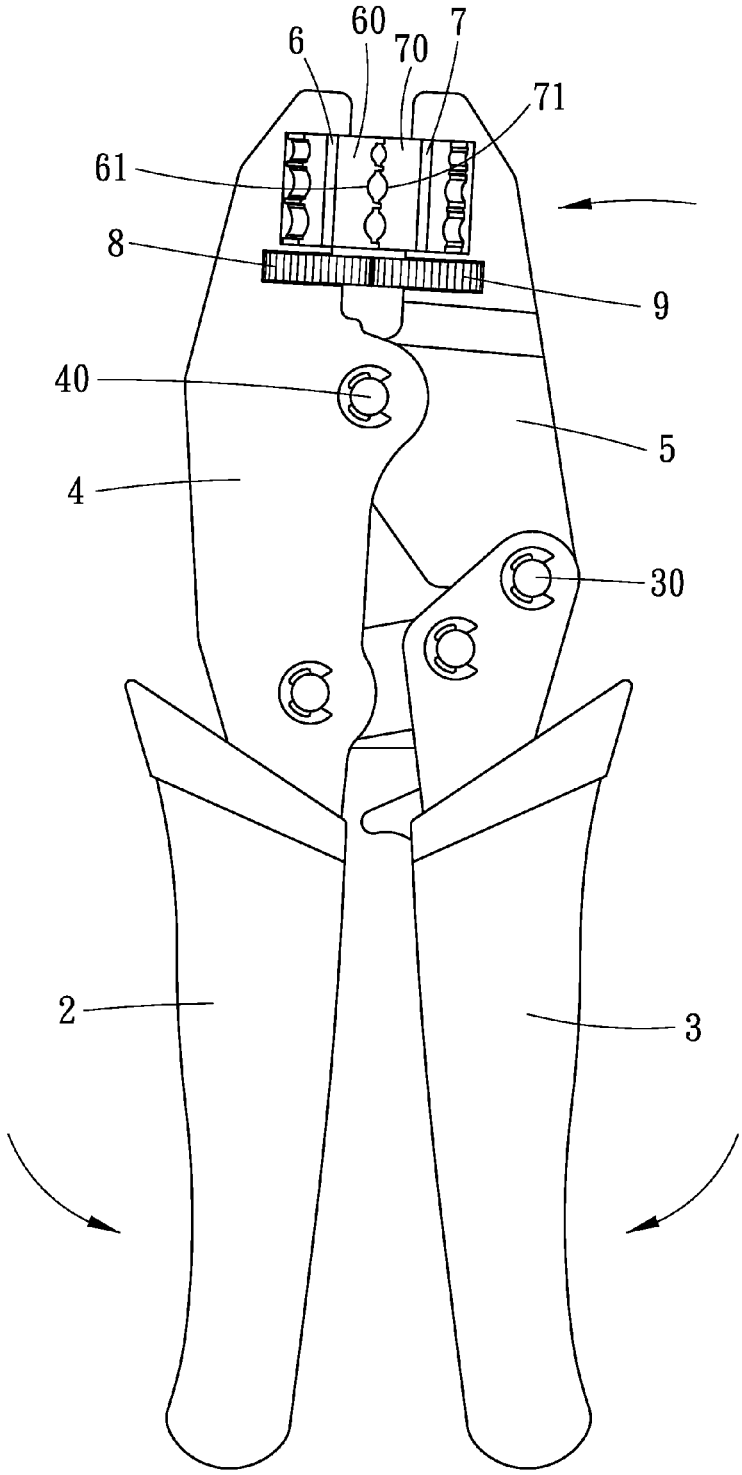
FIG. 6 is a side view of the preferred embodiment of pliers in the present invention, showing the pliers being closed up.
Figure 7:
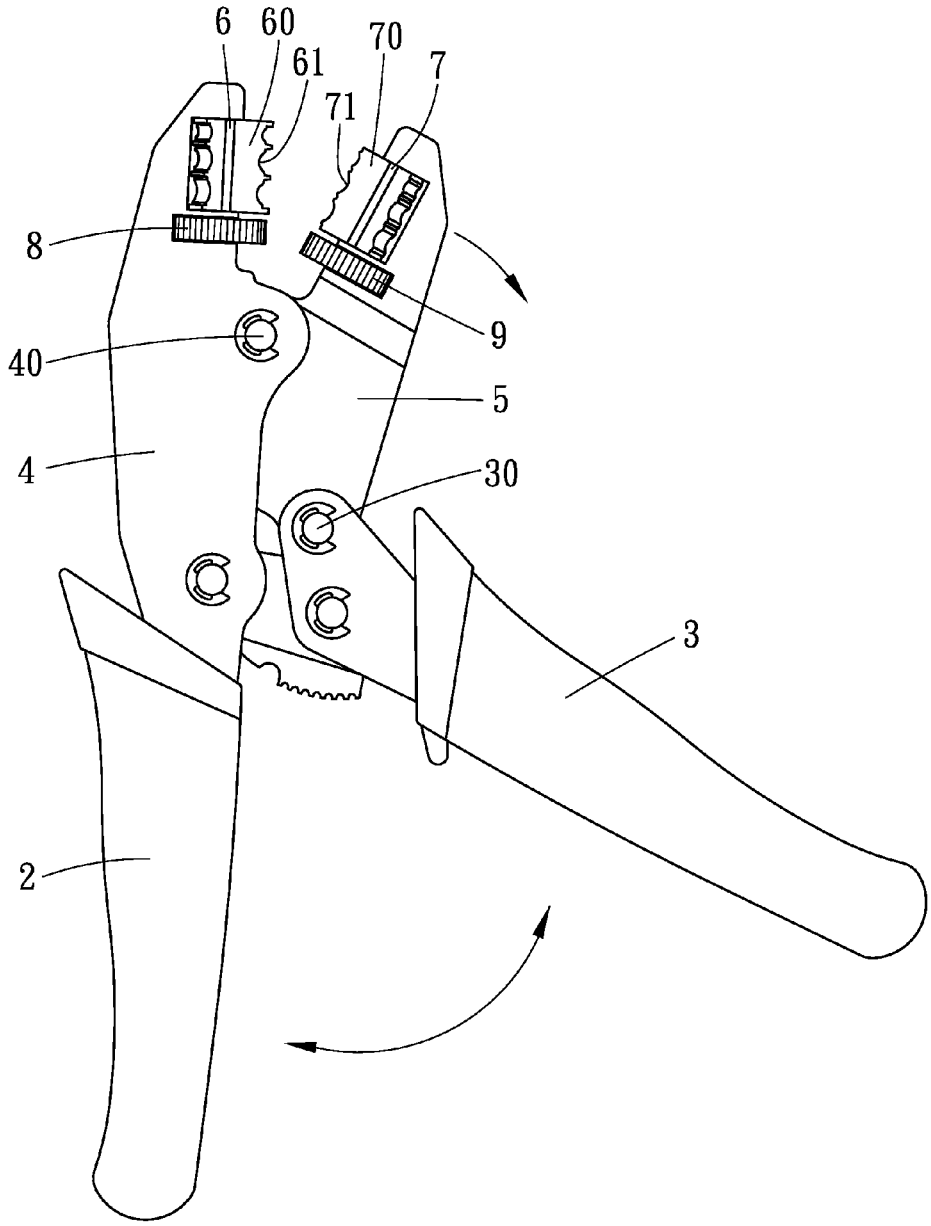
FIG. 7 is a side view of the preferred embodiment of pliers in the present invention, showing the pliers being widely opened.

As shown in FIG. 2, a preferred embodiment of pliers in the present invention includes a left grip 2, a right grip 3, a positioned clamping base 4, a movable clamping base 5, two clamping members 6 and 7, and two gears 8 and 9.

The right grip 3 has a pivot 30 pivotally connected with the movable clamping base 5.

The positioned clamping base 4 has a pivot 40. By the pivot 40, the positioned claiming base 4 is pivotally joint with the movable clamping base 5, a notch 41, a recess 42, two holes 43 and 44 respectively bored in a top side of the notch 41 and a bottom of the recess 42 to correspond to each other, and a through hole 45 bored in a bottom of the notch 41.

The movable clamping base 5 has a notch 51 and a recess 52 which are positioned to correspond to the notch 41 and the recess 42, respectively, two holes 53 and 54 respectively bored in a top of a wall enclosing the notch 51 and a bottom of a wall enclosing the recess 52 to correspond to each other, and a through hole 55 bored in the bottom of the wall enclosing the notch 51.

The clamping member 6 is to be installed in the notch 41. The clamping member 6 has a Y shape structure with three plates 60 extending from a center thereof. An outer edge of each plate is formed with a plurality of curved grooves 60. A bar 62 and a shaft 63 are respectively formed on a top and a bottom thereof, and a restricting slot 64 is axially formed along the shaft 63.

The clamping member 7 is to be installed in the notch 51. The clamping member 7 has a Y shape structure with three plate 70 extending from a center thereof. An outer edge of each plate 70 is formed with a plurality of curved projections 71 the number of which is equivalent to the number of the curved grooves 61 of the clamping member 6. A bar 72 and a shaft 73 are respectively formed on a top and a bottom thereof, and a restricting slot 74 is axially formed along the shaft 73.

The gears 8 and 9 are respectively installed in the recess 42 of the positioned clamping base 4 and the recess 52 of the movable clamping base 5. The gear 8 has a through hole 80 at a center thereof and a restricting projection 81 extending from the through hole 80; and the gear 9 has a through hole 90 at a center thereof and a restricting projection 81 extending from the through hole 90.

In assembling, as shown in FIGS. 2~5, the gears 8 and 9 are respectively fitted in recesses 42 and 52 of the positioned clamping base 4 and the movable clamping base 5, keeping the through holes 80 and 90 respectively corresponding to the through holes 45 and 55 of the positioned clamping base 4 and the movable clamping base 5. Next, the clamping members 6 and 7 are placed into the notches 41 and 51 of the positioned clamping base 4 and the movable clamping base 5 respectively, with the shafts 63 and 73 respectively penetrating through the through holes 45 and 55 of the positioned clamping base 4 and the movable clamping base 5 and the through holes 80 and 90 of the gears 8 and 9; and the restricting projections 81 and 91 are respectively fitted in the restricting slots 64 and 74 of the shafts 63 and 73, The bottoms of the shafts 63 and 73 respectively insert into the holes 44 and 54 of the recesses 42 and 52. By the time, the gears 8 and 9 are respectively positioned in the recesses 42 and 52 of the positioned clamping base 4 and the movable clamping base 5. The bars 62 and 72 of the clamping members 6 and 7 are respectively fitted in the holes 43 and 53 of the positioned clamping base 4 and the movable clamping base 5. Thus, the clamping members 6 and 7 are respectively positioned in the notches 41 and 51 of the positioned clamping base 4 and the movable clamping base 51. The whole assembly of the invention is complete.

In using, as shown in FIGS. 4~7, according to the specification of the conducting line to be pressed, the plates 60 and 70 of the clamping members 6 and 7 are firstly turned around to the proper position. Next, the left grip 2 and the right grip 3 are grape and forced to move toward each other, so that the clamping member 7 is moved to lean against the clamping member 6 to keep the plates 60 and 70 corresponding to each other, and thus the gear 9 are engaged with the gear 8. Then, the gear 8 (or the gear 9) is turned around to drive the gear 9 (or the gear 8) to simultaneously turn around in an opposite direction, enabling the shafts 63 and 73 to rotate so as to keep the clamping members 6 and 7 whirled in opposite directions until the plates 60 and 70 conform to the specification of the conducting line are correspondingly moved to a position close enough. By the time, the conducting line to be pressed is successively put in the curved groove 61, and then the left grip 2 and the right grip 3 are forced to move toward each other to enable the clamping member 7 installed in the movable clamping base 5 so as to lean beside the clamping member 6 of the positioned clamping base 4. Finally, with a further pressing, the conducting line can be pressed by the curved projections 71 of the clamping member 7 for being combined with a terminal. Therefore, with diverse sizes of the curved grooves 61 and the curved projections 71 respectively formed in the clamping members 6 and 7 and are correspondent to each other, the pliers of the invention can be used to press different specifications of conducting lines, not only saving cost of tools but also convenient for carrying around.

While the preferred embodiment of the invention has been described above, it will be recognized and understood that various modifications may be made therein and the appended claims are intended to cover all such modifications that may fall within the spirit and scope of the invention.

What is claimed is:

1. Pliers comprising:

a left grip and a right grip;

a positioned clamping base fixed on a top of said left grip and provided with a pivot; by the pivot to pass through the positioned clamping base and a movable clamping base, the positioned claiming base being pivotally jointed with said movable clamping base, a first notch and a first recess formed in said positioned clamping base, two holes respectively bored in a top side of a wall enclosing said first notch and a bottom of a wall enclosing said first recess which are positioned to be correspondent to each other, and a through hole bored in a bottom of the wall enclosing said first notch to communicate with said recess;

said movable clamping base fixed on a top of said right grip and provided with a second notch and a second recess formed in the inner side thereof and being positioned to be correspondent to those of said positioned clamping base, two holes respectively bored in a top side of a wall enclosing said second notch and a bottom of a wall enclosing of said second recess and positioned to be correspondent to each other, and a through hole bored in a bottom of the wall enclosing of said second notch to communicate with said recess;

a first clamping member and a second clamping member respectively installed in said first notch and said second notch of said positioned clamping base and said movable clamping base and the first clamping members having a Y shape structure with three plates extending from a center thereof; an outer edge of each plate of being formed with a plurality of curved grooves; and the second clamping member having a Y shape structure with three plates extending from a center thereof; an outer edge of each plate of the second clamping member being formed with a plurality of curved projections; the projections being positioned to be correspondent to said curved grooves, and each of said first and second clamping members provided with a bar formed on a top thereof and a shaft formed on a bottom thereof; and two gears respectively installed in said recess of said positioned clamping base and said recess of said movable clamping base and each gear being provided with a through hole; and wherein in assembling state, two gears are respectively fitted in said first and second recesses of said positioned clamping base and said movable clamping base, keeping the through holes of the two gears respectively corresponding to the through holes of the positioned clamping base and the movable clamping base; next, the clamping members are placed into the notches of the positioned clamping base and the movable clamping base respectively, with the two shafts respectively penetrating through the through holes of the positioned clamping base and the movable clamping base and the through holes of the two gears; and the restricting projections and are respectively fitted in the restricting slots and of the two shafts; the bottoms of the shafts respectively insert into the holes of the recesses; by the time, the two gears are respectively positioned in the recesses of the positioned clamping base and the movable clamping base; the bars of the clamping members are respectively fitted in the holes of the positioned clamping base and the movable clamping base; thus the clamping members are respectively positioned in the notches of the positioned clamping base and the movable clamping base.

2. The pliers as claimed in claim 1, wherein said shaft of each of said clamping members is formed with a restricting slot and said through hole of each of said gears is formed with a restricting projection.

* * * * *